US007681607B2

(12) United States Patent
Palmer

(10) Patent No.: US 7,681,607 B2
(45) **Date of Patent: *Mar. 23, 2010**

(54) MANUAL BULK LIQUID PUMP CONTROL AND DISTRIBUTION SYSTEM

(75) Inventor: David Palmer, San Diego, CA (US)

(73) Assignee: Safety Pumping Systems, Inc., Carlsbad, CA (US)

( * ) Notice: Subject to any disclaimer, the term of this patent is extended or adjusted under 35 U.S.C. 154(b) by 365 days.

This patent is subject to a terminal disclaimer.

(21) Appl. No.: 11/553,273

(22) Filed: Oct. 26, 2006

(65) Prior Publication Data

US 2007/0102060 A1 May 10, 2007

Related U.S. Application Data

(63) Continuation-in-part of application No. 11/534,945, filed on Sep. 25, 2006, which is a continuation of application No. 10/893,053, filed on Jul. 16, 2004, now Pat. No. 7,124,792.

(51) Int. Cl.
*B65B 1/04* (2006.01)

(52) U.S. Cl. ..... 141/231; 141/286; 141/301; 417/231; 137/205; 137/565.12

(58) Field of Classification Search ..... 141/231, 141/301, 302, 286, 192, 98; 417/231; 137/565.12, 137/899.4, 205
See application file for complete search history.

(56) References Cited

U.S. PATENT DOCUMENTS 2,800,365 A 7/1957 Hodges
3,544,010 A 12/1970 Jurdye
3,677,284 A 7/1972 Mendez
3,905,516 A 9/1975 Wisnia
3,971,400 A 7/1976 Thompson
4,131,214 A 12/1978 Rogers
4,177,017 A 12/1979 Schultz
5,020,568 A * 6/1991 Taylor ..... 137/316
5,529,098 A 6/1996 Bravo
5,967,174 A 10/1999 MacDonald
6,499,670 B1 12/2002 Brown et al.
6,623,245 B2 9/2003 Meza et al.
6,945,288 B1 9/2005 Brakefield et al.

* cited by examiner

*Primary Examiner*—Steven O Douglas
(74) *Attorney, Agent, or Firm*—Nydegger & Associates

(57) ABSTRACT

The present invention is a pump control and distribution system consisting of a pump and reversing flow control valve with a single-handle to control flow direction and flow rate of a liquid. The system can be operated at a rate of 0 to 300 gallons per minute and the flow reversed or stopped with a single motion of the operating handle. The flow rate of the liquid can be precisely controlled in either direction, along with the liquid pressure. This allows the use of a constant speed pump turning in one direction and gives the operator the ability to control the product transfer regardless of viscosity or volume. A purge valve connected to the outlet of the pump is used to remove substantially all retained liquid in the system after transfer of liquid is complete. The system can be mounted to a vehicle for delivery of bulk liquids.

38 Claims, 8 Drawing Sheets

MANUAL BULK LIQUID PUMP CONTROL AND DISTRIBUTION SYSTEM

CROSS-REFERENCE TO RELATED APPLICATIONS

This application is a continuation-in-part of U.S. patent application Ser. No. 11/534,945 filed on Sep. 25, 2006, incorporated herein by reference in its entirety, which is a continuation of U.S. patent application Ser. No. 10/893,053 filed on Jul. 16, 2004, now U.S. Pat. No. 7,124,792, incorporated herein by reference in its entirety.

This application is also related to PCT international application serial number PCT/US05/25363 filed on Jul. 18, 2005, and published as WO 2006/20175 on Feb. 12, 2006, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention relates to the field of controlling the directional flow of bulk liquids. Bulk liquids are generally held in large containment vessels to be stored or transported. This patent deals with the precise control and distribution of liquids from these containment vessels along with the capability of pumping liquid back into the containment vessel by the means of suction. Additionally this patent deals with a unique method of removing any excess liquid from the hoses and lines in the system to insure that no liquid is spilled on the ground or retained within the hoses.

Existing methods of pumping and siphoning bulk liquids has in the past been cumbersome where quantities of the liquid are left within the pump, hoses and distribution lines and this liquid is often spilled onto the ground. A great amount of the bulk liquid is in the form of chemicals, fuel and oil products that produce an environmental hazard when spilled. The Environmental Protection Agency (EPA) has endeavored to put strict regulations on the handling and spillage of these liquids. The petroleum tank and containment vessels are extremely regulated, but the pumping systems are not. No standard or performance windows have been made for the installation and capabilities of the pump systems presently in use.

2. Description of Related Art

The new manual bulk liquid pump control and distribution system was designed primarily for the over the road petroleum transportation industry delivering to above the ground tanks, but it has been found to be useful in the handling of a wide variety of other bulk liquids. This patent is not intended be limited in its scope to the petroleum industry only, but has the capability to be effective in the handling of a variety of other bulk liquids. The new manual bulk liquid pump control and distribution system has been designed to revolutionize not only the way bulk liquids are handled by truck tankers but also the way bulk liquids are transferred between containment vessels. Bulk liquids in the petroleum industry consist of gasoline, oil, diesel, aviation-gas, and transmission fluid to anti-freeze, used oil, and more.

In environmentally sensitive areas such as coast lines, rivers, lakes, ski slopes, parks, wetlands, high water tables or any area where underground tanks cannot be used, there is zero tolerance of a contamination spill. Further, underground tanks must be specially designed, manufactured, installed and monitored to detect and prevent leaks. Accordingly, it is extremely expensive to put a tank underground. In these applications, they are filled by a gravity drop, and no pump is required to deliver fuel to these tanks.

Most corporate farms, businesses, municipalities, airports, rental car yards, trucking companies, construction companies, bus companies and railroads use above ground storage tanks. This style of tank requires a pump to fill them. The application of federal law requires like vehicles to respond to their own accidents and rollovers. In the case of the petroleum industry, if a vehicle is rolled over and lying on its side, the fuel must be removed before the vehicle is up-righted. The fuel is salvageable and requires a pump to remove it. The railroad locomotives are filled, and tank cars are loaded and unloaded with the use of pumps mounted on trucks. All package oil facilities that purchase bulk oils and package them for retail sale, use above ground tanks and require vehicles with pumps to fill them. All shipyards and container yards use above ground tanks, and they require pumps mounted on trucks to load and unload fuel on the tugs and tankers.

Presently, not all states are equal in their environmental requirements. California was the first state to have them, and consequently has the highest restrictions with respect to the handling and transportation of hazardous liquids. Many other states have followed suit with similar requirements and the EPA is now beginning to enforce these laws more diligently in all states. The possibility of a trucking company spilling fuel upon disconnecting of the hoses is being greatly scrutinized. There is no longer any tolerance for these types of frequent spills. The manual bulk liquid pump control and distribution system eliminates substantially all spillage in these zero spill environments.

As regulation of the industry continues to increase, more above ground fuel tanks will be installed to replace underground tanks, resulting in a dramatic increase in above ground pumping applications. Today in California, if you are a jobber that contracts to Chevron, you are required to have a pump installed on your truck to service their customers. That number is growing, and most all new tankers put into service in California will have pumps installed on them. As the agencies tighten the regulations and enforce the environmental laws, more pumps are required to meet the laws governing the above ground fuel storage and handling systems.

The fuel oil transportation industry and chemical transportation industry have problems that are similar to the petroleum industry. Tankers are no longer used as a single delivery of product to an underground tank and back to the refinery for another partial load. These vehicles and operators must be able to multi-task to survive. These include multiple deliveries per load, both gravity and pump loads, numerous drivers per vehicle, variable products, multitudes of tanks and vessels to deliver to, emergency responses, station pump outs, and railroad deliveries, all of which are just some of the different daily conditions. These are all done under the ever-growing scrutiny of the Environmental Protection Agency, Department of Transportation, and insurance industry.

The same environmental laws are now being enforced in international markets as well. Islands such as the Dominican Republic are converting to all above ground tanks and are changing their entire transport fleets. They are using a variety of pumps that are put on trucks with no forethought about problems that might be caused. Every single pump is unique and operates differently. This results in daily spills on each and every delivery, which is no longer an accepted practice.

Accordingly, there is a need for a manual bulk liquid pump control and distribution system which improves upon devices that can transfer bulk liquids and still meet the high standards set by the Environmental Protection Agency, Department of Transportation, the Air Resources Board and the insurance companies. In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

BRIEF SUMMARY OF THE INVENTION

The manual bulk liquid pump control and distribution system, primarily designed for the petroleum transportation industry, was built by the present inventor with safety and the environment at the forefront. The single flow reversing two-way valve handle controls the flow rate and volume of product and eases the stress of operation of this type of equipment. This design makes the unloading and loading of hazardous liquids as safe and efficient as possible along with the ability of removing all the liquid from the lines and hoses. The unique design meets the demands and the stringent requirements set by the Environmental Protection Agency, Air Resources Board, Department of Transportation, A.S.M.E, and various insurance companies.

The unique feature of this invention is the compact features and the simplicity of how it operates along with the ability of solving many of the problems of handling bulk petroleum and other similar products where spills have become an ever-present and dangerous environmental problem.

The present invention is directed to a liquid pump control and distribution system that utilizes a single-handle flow reversing two-way valve for the operational direction of flow and volume, while providing a neutral position for standby. The pump drive will generally be by the means of a clutch-type power takeoff (PTO) from the vehicle engine or an auxiliary engine mounted on the vehicle or on a pallet as a portable device. The system can be operated at a rate of 0 to about 300 gallons per minute and be reversed and controlled with a single motion of the operating handle on the flow reversing two-way valve.

The pump operates in one direction at a fixed RPM, resulting in longer pump life and safer operation. For added safety, the system utilizes the pump's relief valve for both loading and unloading. It must be understood that a variety of different pumps made by different manufactures will perform the same function of pumping the liquid and remain within the scope of this patent. Since the system has a neutral position when the PTO is engaged, no fluid motion or pressure develops until the system gradually begins to operate after all connections are verified by the operator. When the liquid has been transferred, the residue liquid left in the lines and hoses may be removed by raising the end of the hose up trapping the liquid and manually reversing the two-way valve to the suction position.

This system uses an aluminum flow reversing two-way valve with a flat plate impeller. The valve allows the flow of the product to be precisely controlled in either direction, along with flow rate and pressure. This gives the operator the ability to control the product regardless of viscosity or volume. The reversing valve uses recessed O rings on the shafts and flange faces to prevent leaks. A crossover line is easily adapted to the system making easy access to both sides of a vehicle. The design allows for the safest pump operation available for proper handling of a wide variety of products during these environmentally sensitive times.

The system incorporates an easily accessible strainer basket housed within a housing that is inclined so that when the strainer basket cover plate is removed the liquid within does not spill out. An extended handle positions the basket within the chamber so that the flow inters the center of the basket and the cover plate is easily accessible. A unique 110-degree elbow connects the strainer basket housing to the pump positioning the flow reversing two-way valve and valve handle in a convenient and easily accessible location and keeping the system as compact as possible. The strainer basket and housing is designed independently of the particular pump being used making it universal and adaptable to a wide variety of pump configurations.

A purge valve is connected to the pump outlet, the lowest point in the system, to remove retained liquids once transfer of liquids is complete The principal object of the manual bulk liquid pump control and distribution system is to create a unique system that will eliminate substantially all spillage of liquids during the transfer from one containment vessel to a second containment vessel.

Another object of the manual bulk liquid pump control and distribution system is to create a unique way to move bulk liquids in two different directions through a single flow reversing two-way valve without reversing the direction of the pump drive unit.

Another object of the manual bulk liquid pump control and distribution system is to create a unique manual system that will control the flow rate and volume of bulk liquids in either direction while the pump is operating at a constant speed with a single valve handle and no electronic control devices.

Another object of the manual bulk liquid pump control and distribution system is to create a small and compact unit which is easily accessible to an operator.

Another object of the manual bulk liquid pump control and distribution system is to create a system with a crossover line that will access from both sides of a vehicle.

Yet another object is to create a manual bulk liquid pump control and distribution system that can be put in a neutral position where no liquid is pumped in either direction.

And yet, another object is to create a manual bulk liquid pump control and distribution system where the liquid is always forced through the strainer basket in the same direction whether the system is in the discharge or suction mode.

And still another object is to create a manual bulk liquid pump control and distribution system where the strainer basket in the angled strainer basket housing is easily accessible and will not spill liquid when the access port is opened.

A further object of this invention is to create a unique system that is adaptable to a variety of different configurations.

A final object of this invention is to add a new and unique system to the area of transferring bulk liquids from one containment vessel to a second containment vessel while meeting all the new stringent requirements set forth by the Environmental Protection Agency, Department of Transportation, the Air Resources Board and the insurance companies.

An embodiment of the invention is a pump having an inlet and an outlet, a flow control reversing valve fluidly coupled to the inlet and the outlet of the pump, the reversing valve has a first orifice and a second orifice, the reversing valve has a first position and a second position, where when the reversing valve is in the first position, liquid flows from the first orifice to the second orifice, where when the reversing valve is in the second position, liquid flows from the second orifice to the first orifice, where the outlet of the pump is positioned below the reversing valve and the inlet of the pump, and a purge valve fluidly coupled to and positioned below the outlet of the pump.

An aspect of the invention is where the reversing valve has a third position, and where when the reversing valve is in the third position, a liquid pressure difference will not develop between the first orifice and the second orifice.

A further aspect of the invention is where substantially all retained liquid in the reversing valve and in the pump is discharged through the purge valve when the pump is operating, the purge valve is opened, and the reversing valve is moved from the third position to the first position.

A still further aspect of the invention is a hose having first and second ends, the first end of the hose adapted to couple to the second orifice, and where retained liquid from the hose flows into the reversing valve through the second orifice when the second end of the hose is elevated above the second orifice and the position of the reversing valve is moved from the third position to the second position.

Another aspect of the invention is where a change in position of the reversing valve between the first position and the second position changes the flow rate of liquid flowing between the first orifice and the second orifice.

A yet further aspect of the invention is where a change in position of the reversing valve between the first position and the second position changes the liquid pressure difference between the first orifice and the second orifice.

A still further aspect of the invention is a strainer housing coupled to the inlet of the pump, a strainer basket positioned in the strainer housing, where the strainer housing is fluidly coupled to the reversing valve.

Another aspect of the invention is where liquid flows in one direction through the strainer basket when the position of the reversing valve is changed between the first position and the second position.

A still further aspect is a drain plug positioned in the strainer housing.

A further aspect of the invention is where the pump is a constant speed pump and/or a positive displacement pump.

A still further aspect of the invention is an indexing pin coupled to the reversing valve, where the position of the reversing valve is restricted to between the first position and the second position by the indexing pin.

Another aspect of the invention is where the reversing valve is adapted to mount to a vehicle having a liquid reservoir, where the first orifice is adapted to couple to the liquid reservoir, and where the second orifice is adapted to fluidly couple to a liquid receiver.

A further aspect of the invention is where the reversing valve has a third position, where when the reversing valve is in the third position, a liquid pressure difference will not develop between the first orifice and the second orifice, and where retained liquid in the reversing valve and in the pump is discharged through the purge valve when the pump is operating, the purge valve is opened, and the reversing valve is moved from the third position to the first position.

Another embodiment of the invention is a valve body having a first, second, third and fourth ports, where the first port is adapted to couple to the inlet of a pump, where the second port is adapted to couple to a first containment vessel, where the third port is adapted to couple to the outlet of the pump, where the fourth port is adapted to couple to a second containment vessel, a valve chamber in the center of the valve body, a valve candle adapted to rotate within the valve chamber, the valve candle having a flat impeller, the valve candle having first, second and third positions, where when the valve candle is in the first position, the impeller directs liquid flow from the second port to the first port, and from the third port to the fourth port, where when the valve candle is in the second position, the impeller directs liquid flow from the fourth port to the first port and from the third port to the second port, and where when the valve candle is in the third position, the impeller allows liquid to flow from the third port to the first port.

Another aspect of the invention is an indexing pin attached to the valve candle, a valve bonnet coupled to the valve body, indexing ears attached to the valve bonnet, where the indexing ears interact with the indexing pin to limit the turning range of the valve candle.

A further aspect of the invention is where the valve candle has a top shaft and a bottom shaft, where the top shaft is supported by the valve bonnet, a coil spring positioned on the top shaft between the valve bonnet and the valve candle, a jack screw positioned in the valve body, the jack screw adapted to support the bottom shaft, where the coil spring urges the bottom shaft of the valve candle against the jack screw.

A still further aspect of the invention is where adjusting the jack screw adjusts the position of the valve candle in the valve chamber.

A yet further aspect of the invention is a first recessed O ring on the top shaft, the first O ring positioned to seat in the valve bonnet, a second recessed O ring on the bottom shaft, the second recessed O ring positioned to seat in the valve body, and where the first and second recessed O rings are adapted to resist liquid flow along the top and bottom shafts.

Another aspect of the invention is first, second, third and fourth recessed O rings positioned on the first, second, third and fourth ports respectively, where the first second third and fourth O rings are adapted to resist liquid flow across the face of the ports.

A further aspect of the invention is a strainer housing adapted to couple to the inlet of the pump, a strainer basket positioned in the strainer housing, where the strainer housing is fluidly coupled to the first port.

A still further aspect of the invention is where liquid flows in one direction through the strainer basket when the position of the valve candle is changed between the first position and the second position.

A yet further aspect of the invention is where the valve body is mounted to a vehicle, and where the fourth port is fluidly coupled to a crossover line that will access liquid from both sides of the vehicle.

Another aspect of the invention is where the second port is adapted to couple to a first containment vessel mounted on the vehicle, and where the crossover line is adapted to couple to a second containment vessel.

A still further aspect is where the second port is fluidly connected to a second crossover line that will access liquid from both sides of the vehicle.

A further aspect of the invention is a hose having first and second ends, the first end adapted to couple to the crossover line, and where retained liquid from the hose flows into the valve body through the fourth port when the second end of the hose is elevated above the crossover line and the position of the valve candle is moved from the third position to the second position.

A further embodiment of the invention is a method of distributing liquid that comprises providing a pump having an inlet and an outlet, providing a two way flow reversing valve having a first, second, third and fourth ports, coupling the pump inlet to the first port, coupling the pump outlet to the third port, coupling a first containment vessel to the second port, coupling a second containment vessel to the fourth port, where the flow reversing valve has a first position and second position, engaging the pump, moving the flow reversing valve to the first position, and distributing liquid from the first containment vessel to the second containment vessel.

Another aspect of the invention is a method where the flow reversing valve has a third position, where when the flow reversing valve is in the third position, liquid does not flow between the second port and the fourth port, and positioning the flow reversing valve in the third position before the pump is engaged.

A further aspect of the invention is providing a hose having a first end and second end, coupling the first end of the hose to the fourth port, and coupling the second end of the hose to the second containment vessel.

a still further aspect of the invention is uncoupling the second end of the hose from the second containment vessel, elevating the second end of the hose above the fourth port, and moving the flow reversing valve to the second position to remove the retained liquid from the hose.

A yet further aspect of the invention is coupling a purge valve to the pump outlet, disconnecting the second containment vessel from the fourth port, engaging the pump, opening the purge valve, moving the flow reversing valve to the first position thereby discharging retained fluid through the purge valve.

Another aspect of the invention is providing a strainer housing coupled to the inlet of the pump and coupled to the flow reversing valve, flowing fluid in a first direction through the strainer housing when the flow reversing valve is in the first position, and flowing fluid in the first direction through the strainer housing when the flow reversing valve is in the second position.

A still further aspect is providing a drain port in the strainer housing and opening the drain port to drain retained liquid from the strainer housing.

A further aspect of the invention is supporting the first containment vessel on a vehicle, supporting the pump on the vehicle, and supporting the flow reversing valve on the vehicle.

A still further aspect of the invention is coupling a purge valve to the pump outlet, disconnecting the second containment vessel from the fourth port, engaging the pump, opening the purge valve, moving the flow reversing valve to the first position thereby discharging retained fluid through the purge valve.

Another aspect of the invention is supporting a third containment vessel from said vehicle; disconnecting the first containment vessel from the second port; connecting the third containment vessel to the second port; engaging the pump; moving the flow reversing valve to the first position; and distributing liquid from the third containment vessel through the fourth port.

A yet further aspect of the invention is disconnecting the second containment vessel from the fourth port, connecting a liquid source to the fourth port, engaging the pump, moving the flow reversing valve to the second position thereby refilling the first containment vessel from the liquid source.

Another aspect of the invention is coupling a purge valve to the pump outlet, disconnecting the liquid source from the fourth port, engaging the pump, opening the purge valve, and moving the flow reversing valve to the first position thereby discharging retained fluid through the purge valve.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The accompanying drawings, which are incorporated in and form a part of this specification, illustrate embodiments of the invention and together with the detailed description, serve to explain the principles of this invention.

DETAILED DESCRIPTION OF THE INVENTION

Referring more specifically to the drawings, for illustrative purposes the present invention is embodied in the apparatus generally shown in FIG. 1 through FIG. 12. It will be appreciated that the apparatus may vary as to configuration and as to details of the parts, and that the method may vary as to the specific steps and sequence, without departing from the basic concepts as disclosed herein.

Figure 1:
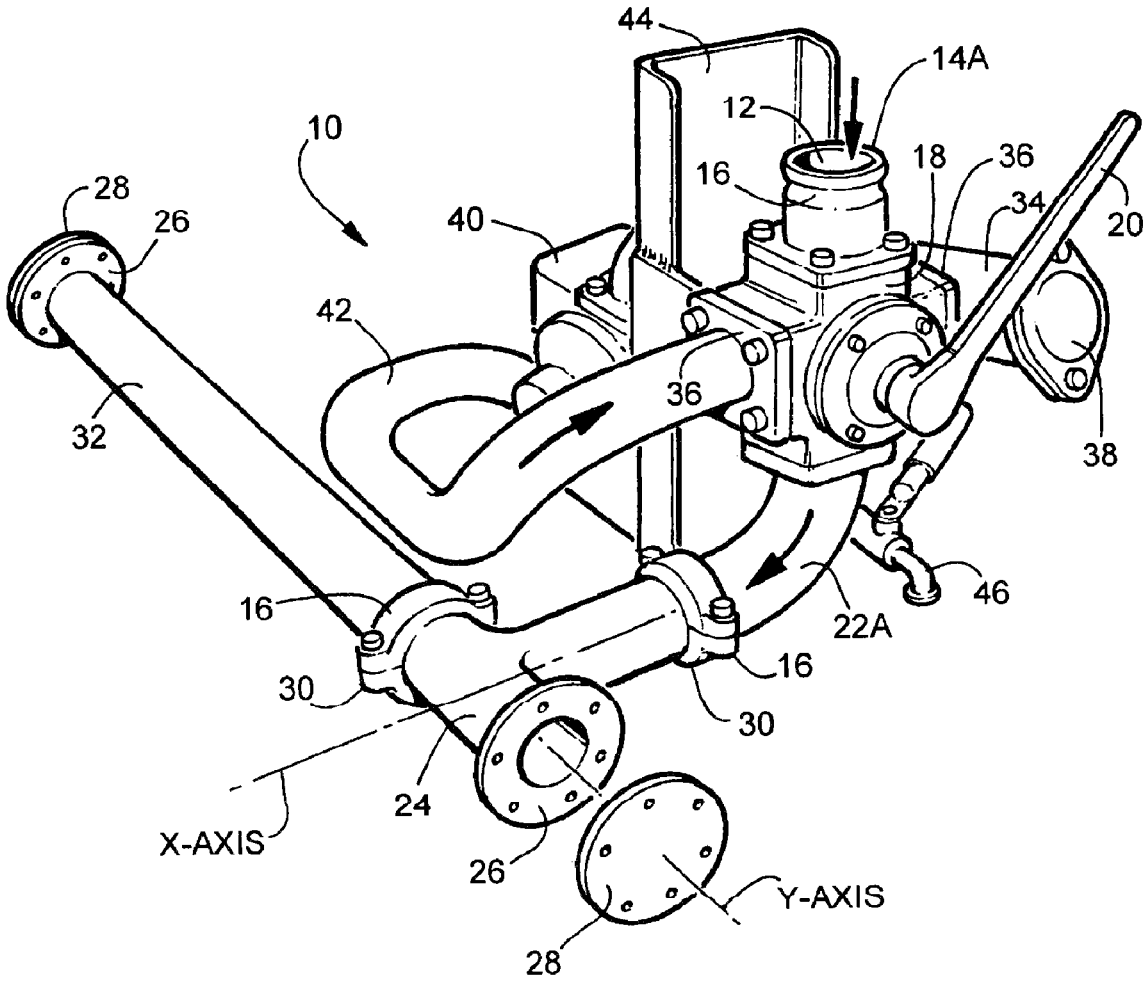
FIG. 1 depicts a perspective view of the left side of the manual bulk liquid pump control and distribution system illustrating the directional discharge flow of the bulk liquid with the intake orifice at the top and the discharge at the bottom.

There is seen in FIG. 1 a perspective view of the left side of the manual bulk liquid pump control and distribution system 10. This view illustrates the directional discharge flow of the bulk liquid with arrows having the intake orifice 12 in the flanged coupling 14A with a flexible victaulic coupling means 16 at the top of the flow reversing two-way valve 18. The flow reversing two-way valve 18 is shown with the valve handle 20 to the right in the discharge position. At the bottom of the flow reversing two-way valve 18, the discharge orifice connects to a 90-degree elbow 22 connected to a T-section 24 having two flexible victaulic coupling means 16, a conventional mounting flange 26 and cover plate 28. The flexible victaulic coupling means 16 uses an o-ring seal with a two-piece clamp ring 30 to give a sealed coupling that is similar to a ball joint type of flexible connection. One or more of these victaulic coupling means 16 or similar flexible sealed connecting means may be used on or between the lines or fittings in this system for flexibility and still remain within the scope of this patent. Coupled to the T-section 24 is a crossover line 32 having a similar conventional flange 26 and cover plate 28. The flexible victaulic coupling means 16 between the 90-degree elbow 22 and the T-section 24 allows flexibility along the X-axis parallel to the frame of the vehicle. The flexible victaulic coupling means 16 between the T-section 24 and the crossover line 32 allows flexibility along the Y-axis perpendicular to the frame of the vehicle. The angled strainer basket housing 34 is shown attached to the right side of the flow reversing two-way valve 18 by the means of a square-mounting flange 36. The strainer basket housing 34 has a cover plate 38. The conventional pump 40 is shown at the rear with an inter-connecting line 42 attached to the left side of the reversing two-way valve 18 by the means of a square-mounting flange 36. A pump mounting bracket 44 is attached to the conventional pump 40, the flow reversing two-way valve 18 and the frame of the vehicle supporting the assembly. A pump drain valve 46 is shown on the lower right side positioned to drain substantially all fluid from the pump control and distribution system 10.

Figure 2:
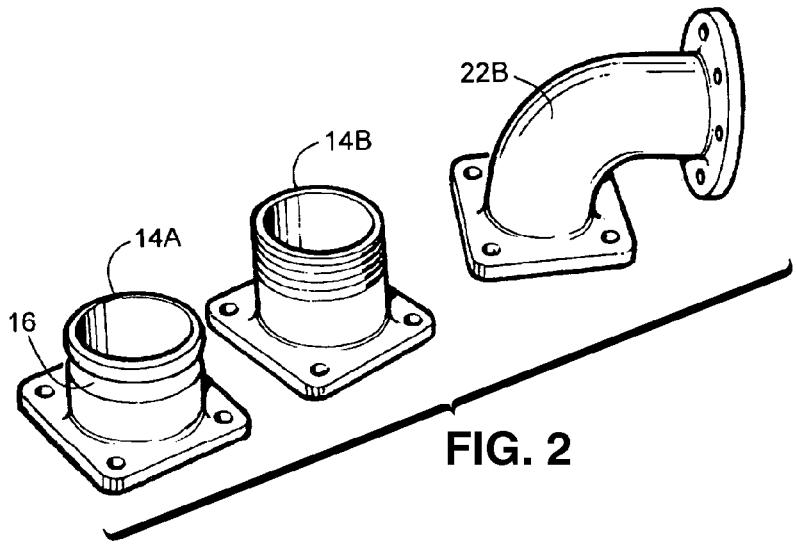
FIG. 2 depicts a perspective view of a variety of different couplings that can be used to adapt the manual bulk liquid pump control and distribution system into different configurations.

FIG. 2 depicts a perspective view of a variety of different couplings that can be used to adapt the manual bulk-liquid pump control and distribution system 10 into different configurations. The first fitting on the left is the flanged coupling 14A with the flexible victaulic coupling means 16. The second fitting is a threaded flanged coupling 14B. The third is a flanged elbow 22B, to be used when the crossover line 32 is not desired.

Figure 3:
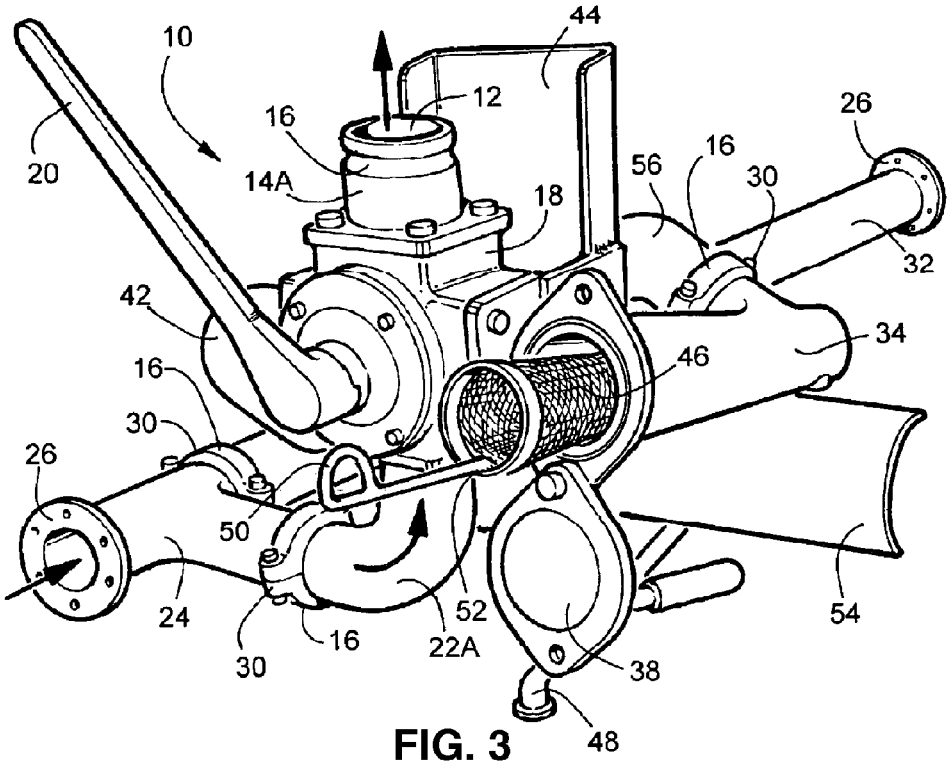
FIG. 3 depicts a perspective view of the right side of the manual bulk liquid pump control and distribution system illustrating the directional suction flow of the bulk liquid along with the strainer basket partly removed from the strainer housing.

FIG. 3 depicts a perspective view of the right side of the manual bulk liquid pump control and distribution system 10 illustrating the directional suction flow of the bulk liquid along with the strainer basket 48 partly removed from strainer basket housing 34. The extended handle 50 mounted on the lip 52 of the strainer basket 48 extends the strainer basket housing 34 forward increasing the accessibility to the cover plate 38. Note at this point that no matter whether the flow reversing two-way valve 18 is in the discharge or suction mode that the liquid always passes through the strainer basket 48 in the same direction. At the right is a half-round shield 54 for the drive coupling on the power take off.

Figure 4:
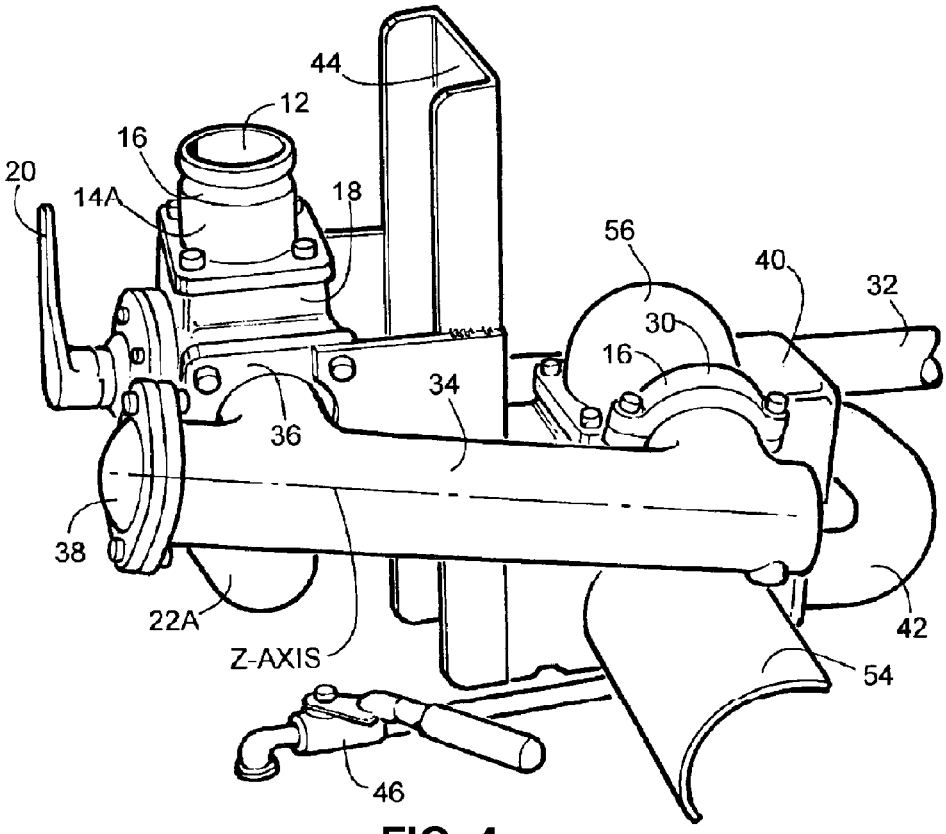
FIG. 4 depicts a perspective side view of the manual bulk liquid pump control and distribution system illustrating the inclined angle of the strainer basket housing.

FIG. 4 depicts a perspective side view of the manual bulk liquid pump control and distribution system 10 illustrating the inclined angle along the Z-axis of the strainer basket housing 34 eliminating spillage when the cover plate 38 is opened for cleaning of the strainer basket 48. A unique angled elbow 56 is used to make the connection between the strainer basket housing 34 and the pump 40 positioning the flow reversing two-way valve 18 and valve handle 20 in a convenient location and keeping the system as compact as possible. The elbow 56 may be custom made with a flange and an angle to fit a variety of different brand name pump specifications. In the preferred embodiment as shown, the elbow 56 is angled at 110-degrees, however many other configurations are anticipated depending on the particular pump used. Similarly, the flange on the inter-connecting line 42 is custom designed to fit the particular pump 40 used.

Figure 5:
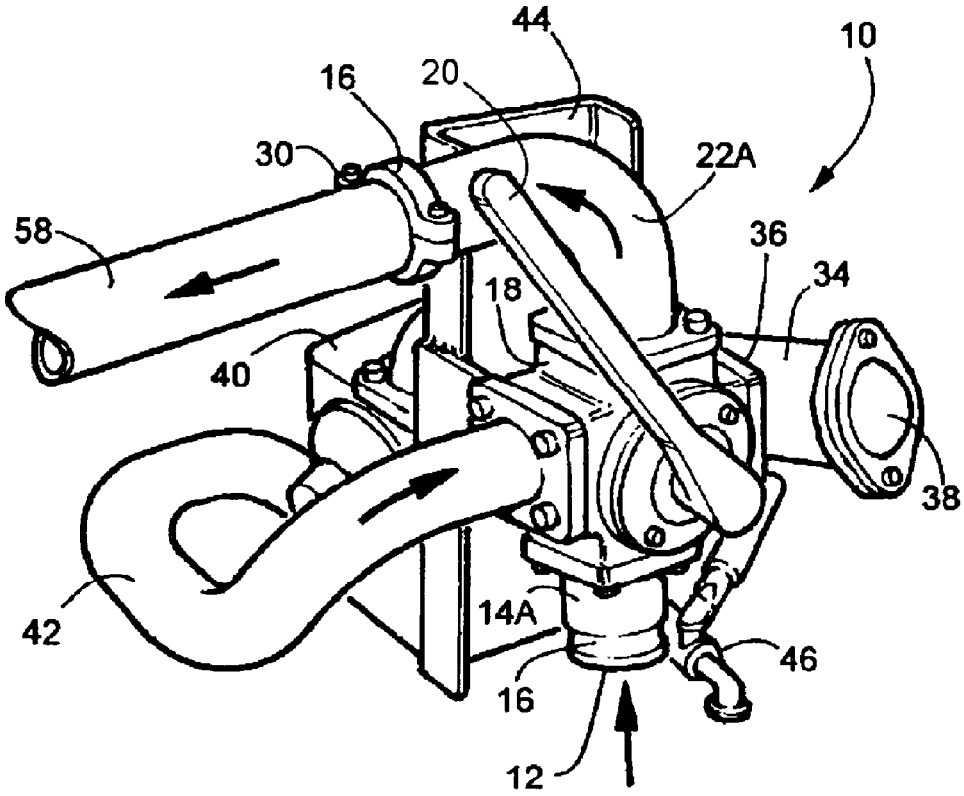
FIG. 5 depicts a perspective view of the left side of the manual bulk liquid pump control and distribution system illustrating one of the alternate configurations with the intake orifice at the bottom and the discharge at the top.

FIG. 5 depicts a perspective view of the left side of the manual bulk liquid pump control and distribution system 10 illustrating one of the alternate configurations with the intake orifice 12 in the flanged coupling 14A at the bottom of the flow reversing two way valve 18. The discharge through the 90-degree elbow 22 is at the top with a pipeline 58 going parallel to the frame to the back of the vehicle.

Figure 6:
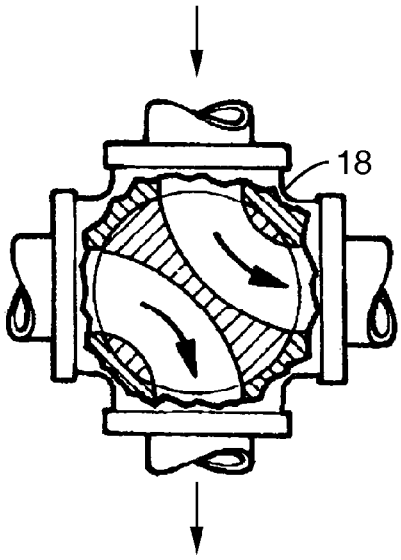
FIG. 6 depicts a side elevation schematic of a flow reversing two-way valve with the side cut away illustrating the flow in the discharge configuration.

FIG. 6 depicts a side elevation schematic of a flow reversing two-way valve 18 with the side cut away illustrating the flow pattern in the discharge configuration.

Figure 7:
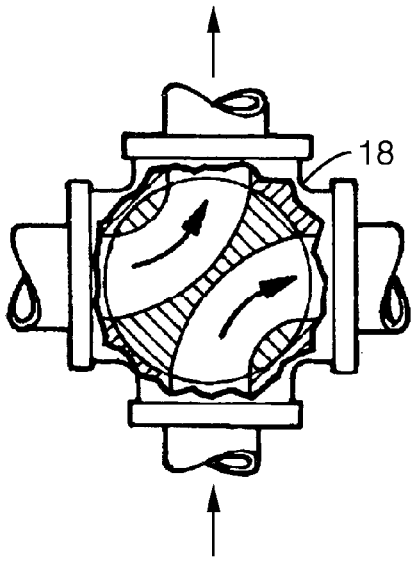
FIG. 7 depicts a side elevation schematic of a flow reversing two-way valve with the side cut away illustrating the flow in the suction configuration.

FIG. 7 depicts a side elevation schematic of a flow reversing two-way valve 18 with the side cut away illustrating the flow pattern in the suction configuration.

Valve 18 can also be in a third neutral position between the discharge position and suction position where flow or pressure differential is not developed between the inlet orifice and outlet orifice. In one mode, the liquid recirculates between the valve and pump. Handle 20 (shown in FIG. 1 and FIG. 5) is used to change the liquid flow direction in valve 18. Adjusting handle 20 between the neutral position and either the discharge position or the suction position will change the flow rate of liquid through valve 18.

Figure 8:
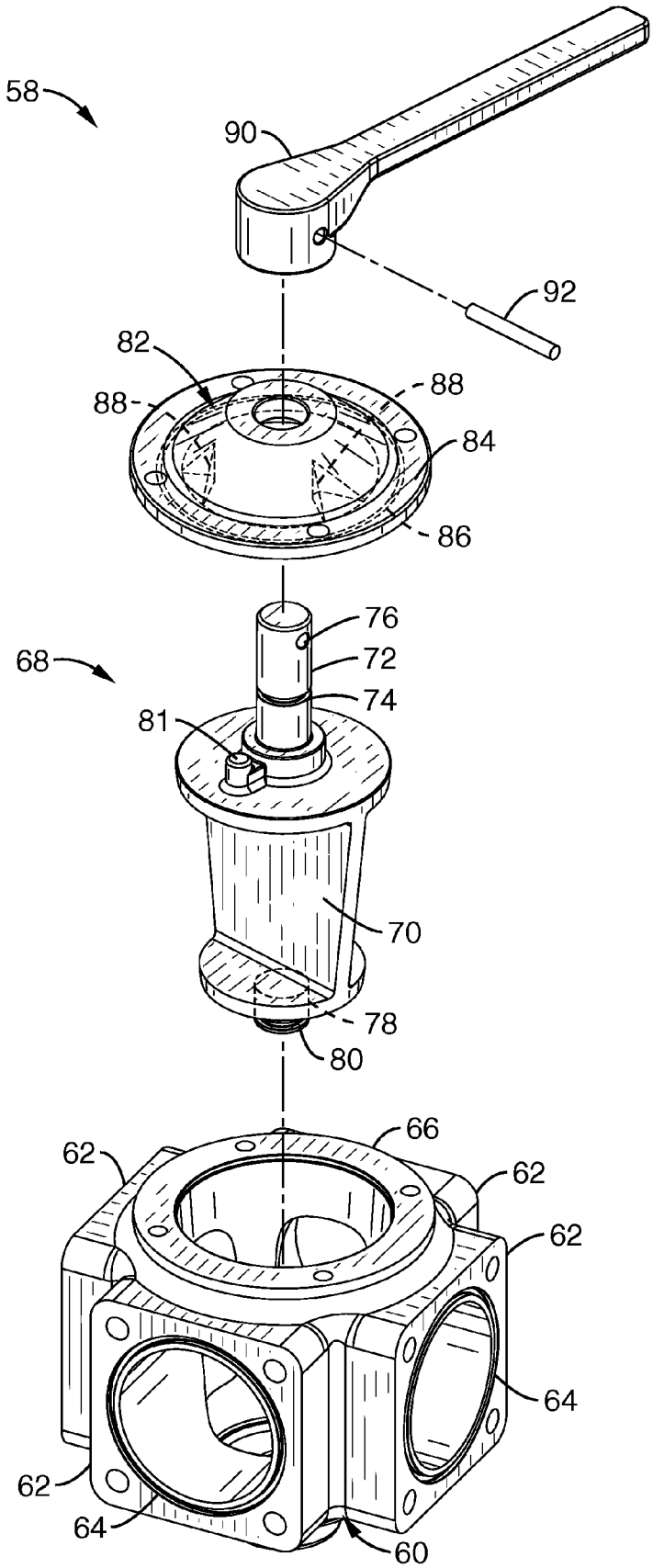
FIG. 8 is an exploded view of another embodiment of a two-way reversing flow control valve for liquid distribution.

FIG. 8 is an exploded view of another embodiment of a reversing flow control valve 58. Reversing control valve 58 has valve body 60, a truncated conical tapered interior and four flanged ports 62. Each flanged port 62 has a recessed O-ring 64 to provide a leak free coupling across the flange face of the port. Valve body 60 also has a top flange face 66.

Valve candle 68 has a flat plate impeller 70 with tapered sides to match the truncated conical taper in valve body 60. Valve candle 68 has top shaft 72 with a recessed O-ring 74 that interacts with valve bonnet 82 for leak free operation. Aperture 76 is positioned in top shaft 72 to secure a handle. Bottom shaft 78 has a recessed O-ring 80 that interacts with valve body 60 for leak free operation. An indexing pin 81 is mounted on the upper surface of valve candle 68. The impeller 70 is configured to direct liquid flow in and out two adjacent ports when aligned between ports. Impeller 70 can also align with two opposite ports to allow liquid to recirculate within valve 58 and through the pump.

Valve bonnet 82 has flange 84 with recessed O ring 86 adapted to couple to top flange face 66 of valve body 60 and has indexing ears 88 that restrict the turning range of valve candle 68 by restricting the travel of indexing pin 81 and providing tactile resistance at the end of the range. In this embodiment, the turning range of valve 58 extends from the discharge position, through the neutral position and to the suction position. In a further embodiment, valve bonnet 82 has visible markings such as "discharge," "neutral" and "suction" to indicate the position of the valve relative to the position of handle 90. In a still further embodiment, the markings on valve bonnet 82 are "load on," "neutral," and "load off." Handle 90 is coupled to upper shaft 72 with pin 92 that fits through aperture 76 and indexes the handle position relative to the position of impeller 70.

Note that when impeller 70 is positioned in the neutral position in valve body 60, liquid can flow freely between each port 62. In this mode, liquid is recycled through the pump and reversing valve 58 but no pressure is developed between the inlet orifice and outlet orifice. Thus there is no flow of liquid into or out of the inlet orifice or outlet orifice of reversing valve 58.

Figure 9:
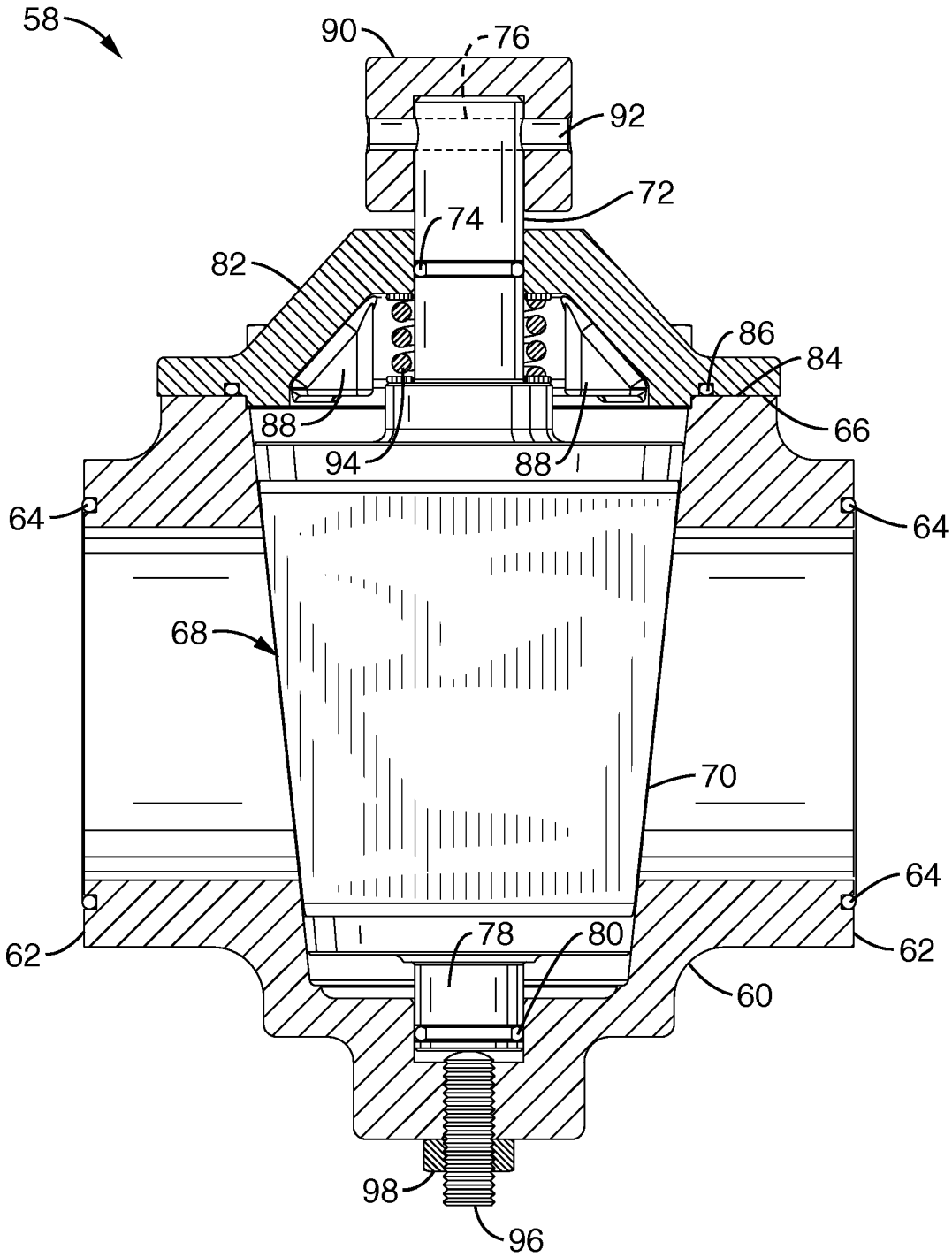
FIG. 9 is a cross section view of the two way reversing flow control valve shown in FIG. 8.

FIG. 9 is a cross section view of reversing flow control valve 58 shown in FIG. 8. Tapered valve candle 68 is seated in the internal chamber of valve body 60. Spring 92 is positioned under bonnet 82 to urge valve candle 68 into the tapered internal chamber of valve body 60. Recessed O-ring 74 seats in the center opening of bonnet 82 to prevent leaking when the fluid in valve 58 is under pressure. Similarly, O-ring 80 positioned on bottom shaft 78 seats in valve body 60 to resist leaks under pressure. Jack screw 96 screws into jack nut 98 which is coupled to the bottom of valve body 60. Jack screw 96 is the lower pivot for bottom shaft 78 and vertical adjustment for optimum positioning of valve candle 68 in the taper of valve body 60 to adjust the tension on handle 90 and prevent binding or leaking.

Figure 10:
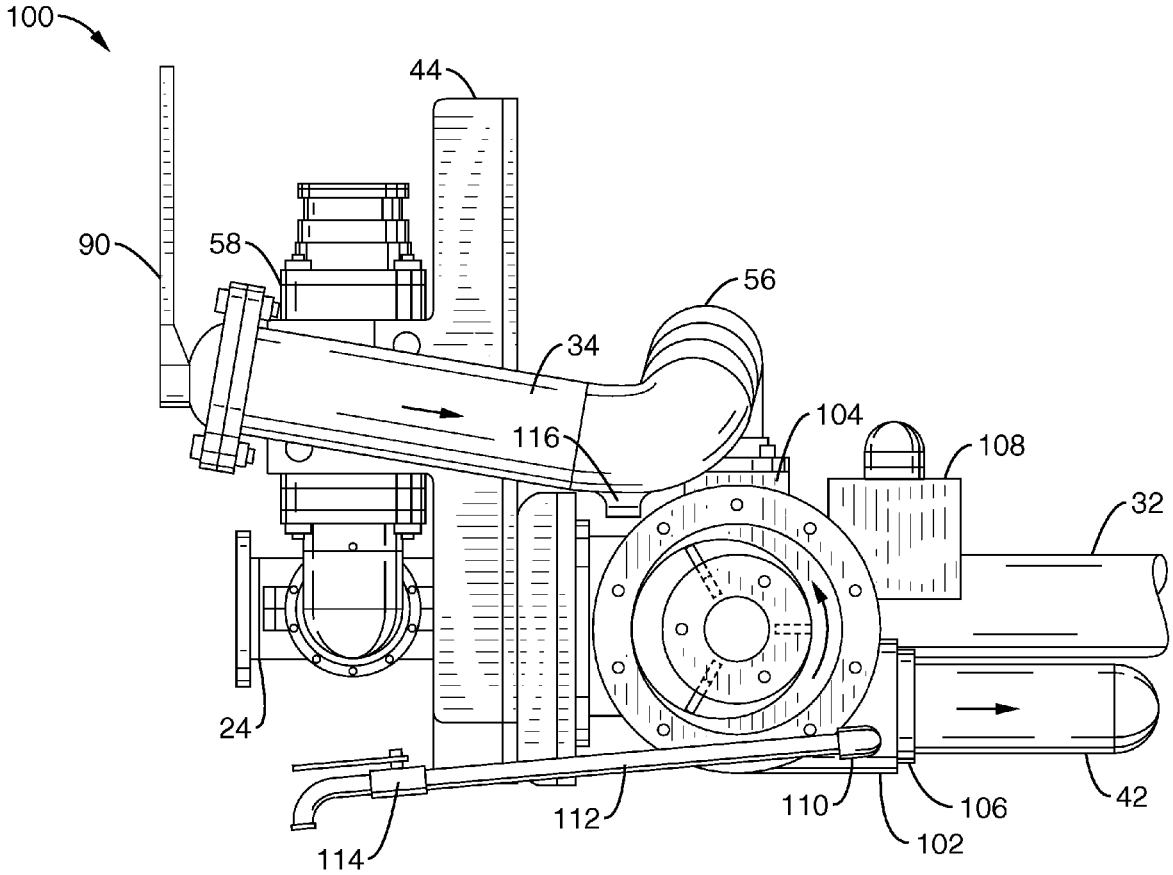
FIG. 10 illustrates a side view of another embodiment of a liquid pump control and distribution system with a vane pump.

FIG. 10 illustrates a side view of another embodiment of a liquid pump control and distribution system 100 with a positive displacement vane pump 102 shown in partial cross section view. Vane pump 102 is shown supported on bracket 44 such as on a vehicle, but could also be skid mounted or permanently mounted near a liquid containment vessel. Pump 102 has inlet 104 fluidly coupled to reversing two-way valve 58 through strainer housing 34 and has outlet 106 fluidly coupled to inter-connecting line 42. In one embodiment, the fittings of pump control and distribution system 100 are about 3 inch in diameter. In a preferred embodiment, pump 102 is a constant speed pump since flow rate and direction can be controlled by valve 58. In a further embodiment, pump 102 is operated by engaging a power take off shaft on a vehicle. In one embodiment, pump 102 can transfer up to 240 gallons per minute of liquid.

Vane Pump 102 has a pressure relief valve 108 that will allow liquid flow from the pump outlet 106 to the pump inlet 104 when the pressure differential exceeds the relief valve setting. In one embodiment, the pressure relief valve is set at about 75 psi. In normal operation using reversing valve 58, relief valve 108 is only required to mitigate fluid hammer during a loaded pump start or quick valve movements since no pressure is developed between the inlet and outlet orifices when reversing valve 58 is in the neutral position.

Port 110 is placed in the sump of pump 102 and positioned at the lowest point liquid can flow in the outlet 106 of pump 102. Preferably, port 110 is positioned at the lowest point liquid can flow in liquid pump control and distribution system 100. In one embodiment, port 110 is ¼ inch NPT. A drain line 112 is sloped downward from port 110 and terminates in a spring-loaded, normally closed "deadman" purge valve 114. In a further contemplated embodiment, a removable container is connected to spring-loaded purge valve 114 to collect fluid drained from liquid pump control and distribution system 100. Purge valve 114 can also be used to pull samples of product being transferred and pressurize the system and test for leaks.

A drain port 116 is also positioned at the lowest point in strainer body 34. This port can be fitted with a valve such as a ball valve or spring loaded valve to drain any liquid remaining in strainer body 34. Since strainer body 34 is coupled to the suction inlet 104 of pump 102, the pump would need to be disengaged before draining liquid through port 116.

After a liquid transfer operation is complete, some liquid is retained in liquid pump control and distribution system 100. When pump 104 is running, opening spring-loaded purge valve 114 and moving handle 90 to the discharge or suction position will build internal pump pressure and discharge substantially all retained liquid in reversing valve 58, pump 104 and associated pipe and fittings. When substantially no liquid remains in outlet 106 of pump 104, the pump will discharge air from purge valve 114. The discharge of air from purge valve 114 is visible and audible.

A method of using pump control and distribution system 100 is described as follows: The first port of reversing valve 58 is coupled to inlet 104 of pump 102 and the third port of reversing valve 58 is coupled to outlet 106 of pump 102. Typically, there are ball or butterfly shut off valves with victaulic or flange fittings installed at the inlet orifice connection and the selected outlet of crossover pipe 32. The first containment vessel or liquid reservoir is connected to the inlet orifice or second port of reversing valve 58. The second containment vessel or liquid receiver is connected to the outlet orifice or fourth port through crossover pipe 32, typically with a hose. Handle 90 of valve 58 is placed in the neutral position. The operator opens the shut off valve to the liquid receiver and starts or engages pump 102. Next the shut off valve on the crossover pipe to the hose is opened. Handle 90 is then moved slowly to the discharge position until liquid flows from the liquid reservoir through the two way reversing valve 58 and into the liquid receiver. During the liquid transfer, handle 90 can be moved anywhere between the discharge and suction positions. For example, handle 90 can be moved quickly from the discharge position to the suction position if a leak is observed or the hose becomes accidentally disconnected.

When the transfer of liquid is complete, handle 90 of valve 58 is moved to the neutral position to stop flow of liquid and the shut off valve to the liquid reservoir is closed. Next, the hose is disconnected from the liquid receiver, keeping the open end of the hose elevated above the crossover line to prevent spillage of retained liquid.

Next, the operator moves handle 90 of reversing valve 58 to the suction position and walks the hose end up towards the connection with crossover pipe 32 until substantially all retained liquid in the hose flows into pump control and distribution system 100. When this step is completed the valve to the hose is closed, thereby retaining the liquid in reversing valve 58 and pump 104. The operator moves handle 90 to the neutral position and disengages or turns off pump 104.

At this point hoses and vents can be removed and stored, ports capped and the vehicle moved to the next destination to distribute liquid. Alternately, another containment vessel or liquid reservoir on the vehicle can be connected to the pump control and distribution system 100 to transfer liquid to another liquid receiver.

The first containment vessel on the vehicle can be refilled by connecting a liquid source to the fourth port of reversing valve 58, opening the internal valves, engaging the pump and moving handle 90 to the second or suction position. Liquid will flow from the liquid source through the fourth port and into the first containment vessel through the second port. Flow of liquid is stopped by moving handle 90 to the neutral position.

In some situations, it is desired to remove all retained liquids in pump control and distribution system 100 before transferring a different liquid from a different containment vessel. A method to remove substantially all retained liquid from the pump control and distribution system 100 after transferring liquid is as follows: After liquid is transferred and the shut off valves to the liquid receiver, the liquid reservoir and to the hose are closed, position handle 90 to the neutral position and start the pump. Place a container under spring-loaded purge valve 114. Move handle 90 slowly to the discharge position and open purge valve 114. Pump 104 will discharge substantially all retained liquid in pump control and distribution system 100 through drain line 112 and out purge valve 114. Collect purged liquid in the container until only air is discharged from purge valve 114. Release spring-loaded purge valve 114, return handle 90 to the neutral position and turn off pump 104. At this point, there is substantially no liquid retained in the system. The discharge of air from purge valve 114 can be seen and heard and is an observable indicator that there is substantially no liquid retained in pump control and distribution system 100.

An additional step to ensure and verify that no liquid remains in pump control and distribution system 100 is to open port 116 in strainer body 34 after pump 102 is off to drain any remaining liquid retained in strainer body 34.

If verification is desired that substantially no liquid is retained in the system, a witness can observe that only air is discharged from spring-loaded purge valve 114 and annotate the delivery log. This verification that substantially no liquid is retained can be made at the end of a liquid transfer or prior to filling the liquid reservoir. The observer can also verify that port 116 in strainer body 34 was opened to drain any remaining liquid. Verification that substantially no liquid is retained in the distribution system is particularly important when different liquids are distributed and cross contamination with even a small amount of retained liquid cannot be tolerated.

Verification of substantially no liquid retained in a liquid reservoir connected to the inlet orifice and positioned above pump control and distribution system 100 can be accomplished just prior to refilling the liquid reservoir as follows: First, close the shut off valve to the outlet orifice. Position handle 90 to the neutral position, start the pump and open the internal valve to the liquid reservoir. Move handle 90 first toward the discharge position to remove any retained liquid from the liquid reservoir, then close the internal valve on the liquid reservoir. Place a container under spring-loaded purge valve 114 and open spring-loaded purge valve 114 and move handle 90 toward the suction position and until only air is discharged. Close purge valve 114, move handle 90 to the neutral position and turn the pump off. An additional step would be to open port 116 in strainer body 34 and drain any remaining fluid after pump 102 is shut off. Verification that substantially no liquid is retained in the liquid reservoir is particularly important when cross contamination with even a small amount of retained liquid cannot be tolerated.

Figure 11:
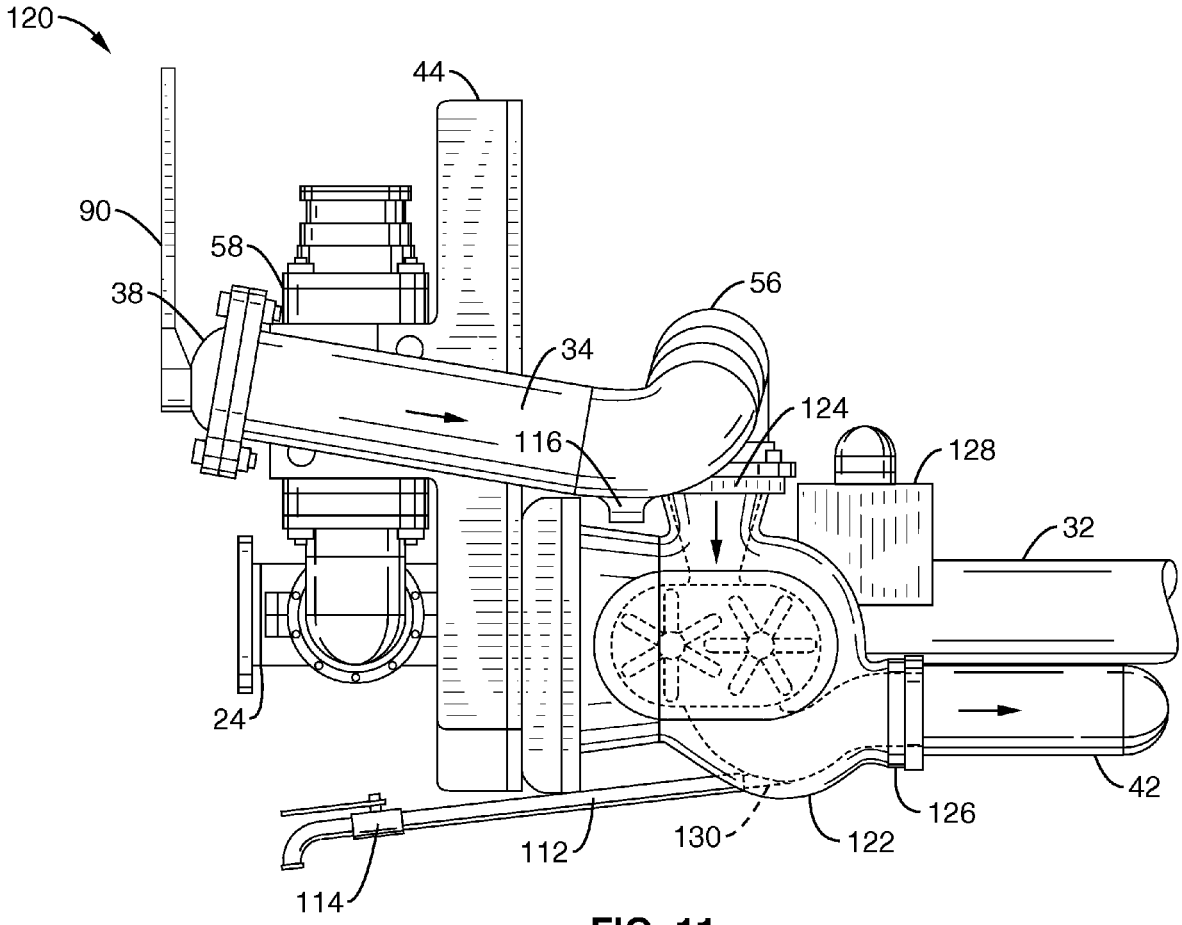
FIG. 11 illustrates a side view of a further embodiment of a liquid pump control and distribution system with a gear pump.

FIG. 11 illustrates a side view of further embodiment of a liquid pump control and distribution system 120 with a positive displacement gear pump 122 shown in partial cross section view. Pump 122 is supported on bracket 44 and has inlet 124 fluidly coupled to reversing two-way valve 58 through strainer housing 34 and has outlet 126 fluidly coupled to inter-connecting line 42. Pump 122 also has a relief valve 128 that will recycle liquid from the pump outlet 126 to the pump inlet 124 when the pump is running and the pressure exceeds the relief valve setting. In one embodiment, pump 122 has about a 3 inch diameter inlet and outlet and can transfer up to about 130 GPM of liquid. In another embodiment, pump 122 has about a 4 inch inlet and outlet and can transfer up to about 300 GPM of liquid. In a preferred embodiment, pump 122 is a constant speed pump since flow rate can be controlled by valve 58.

Port 130 is positioned in the sump of pump 122, which is the lowest point liquid can flow in the outlet 126 of pump 122. Preferably, port 130 is positioned at the lowest point liquid can flow in liquid pump control and distribution system 120. A drain line 112 is sloped downward from port 120 and connects a spring-loaded, normally closed "deadman" purge valve 114.

A drain port 116 is also positioned at the lowest point in strainer body 34. This port can be fitted with a drain plug or valve such as a ball valve or spring loaded valve to drain any liquid remaining in strainer body 34.

In a less preferred embodiment, a centrifugal pump or a diaphragm pump is configured to operate with reversing flow control valve 58 to transfer liquids.

Figure 12:
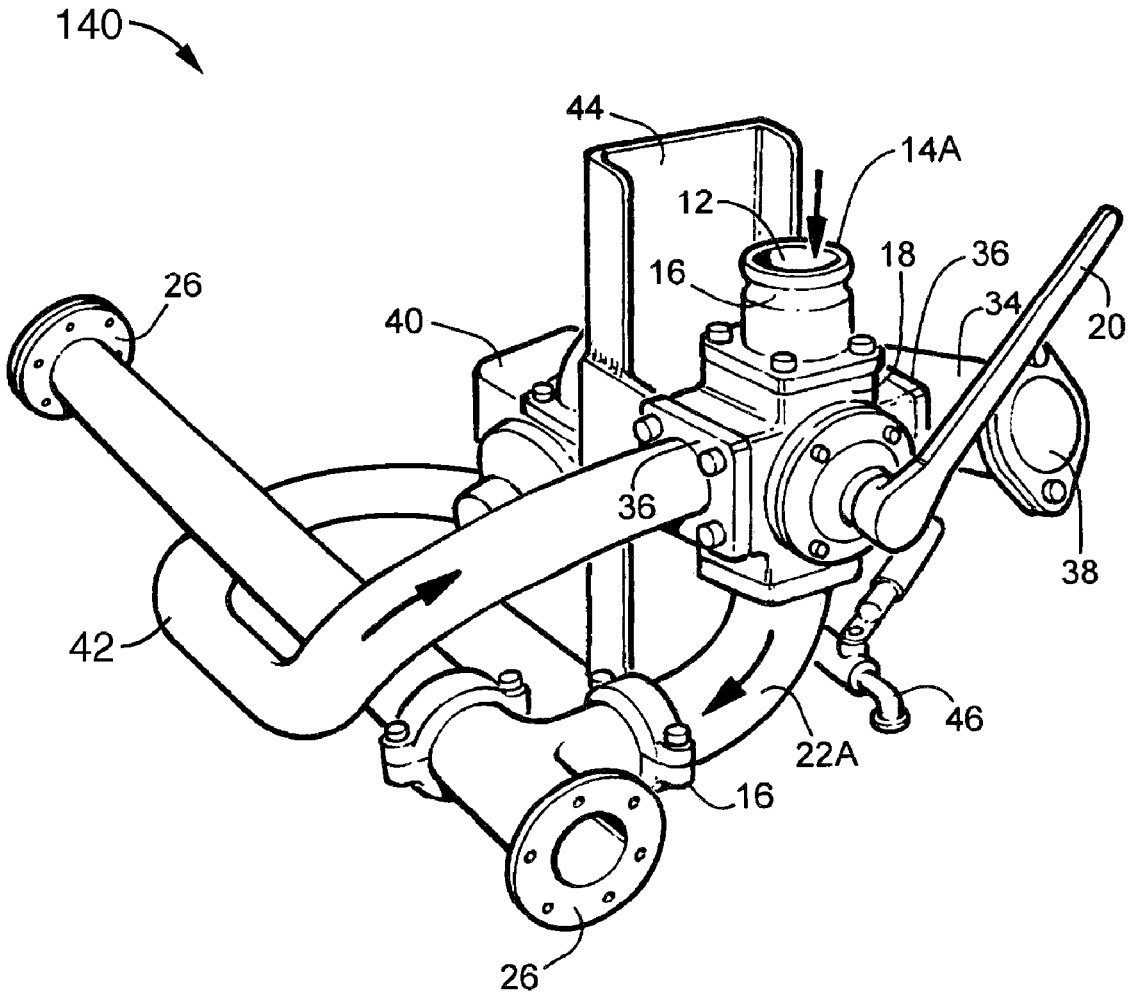
FIG. 12 depicts a perspective view of the left side of the manual bulk liquid pump control and distribution system shown in FIG. 1 illustrating a crossover line mounted inside the interconnecting line.

FIG. 12 illustrates another embodiment of a manual bulk liquid pump control and distribution system 140 similar to FIG. 1 but where crossover line 32 is positioned inside interconnecting line 42. This embodiment allows manual bulk liquid pump control and distribution system 140 to be mounted in a compact area, such as under a vehicle. In one mode of this embodiment, the front shaft of pump 40 is shortened or removed so as not to interfere with crossover line 30.

In a further embodiment, an additional top crossover line can be coupled to intake orifice 12. In this configuration, liquid can be pumped from one side of the system and discharged to the other side of the system. This configuration is particularly useful when access to the system is restricted for loading or offloading liquid. An example is where a system is mounted on a vehicle and hoses cannot be placed beneath the vehicle for access or safety reasons. This configuration can also add versatility to a system that needs to change liquid transfer modes quickly such as a fire suppression vehicle.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for distributing a liquid comprising:

a pump having an inlet and an outlet;

a flow control reversing valve fluidly coupled to the inlet and the outlet of said pump;

said reversing valve having a first orifice and a second orifice;

said reversing valve having a first position and a second position;

wherein when said reversing valve is in said first position, liquid flows from said first orifice to said second orifice;

wherein when said reversing valve is in said second position, liquid flows from said second orifice to said first orifice;

wherein said outlet of said pump is positioned below said reversing valve and said inlet of said pump;

a purge valve fluidly coupled to and positioned below said outlet of said pump:

a strainer housing coupled to the inlet of said pump; and a strainer basket positioned in said strainer housing wherein said strainer housing is fluidly coupled to said reversing valve.

2. An apparatus as recited in claim 1:

wherein said reversing valve has a third position; and wherein when said reversing valve is in said third position, a liquid pressure difference will not develop between said first orifice and said second orifice.

3. An apparatus as recited in claim 2, wherein substantially all retained liquid in said reversing valve and in said pump is discharged through said purge valve when said pump is operating, said purge valve is opened, and said reversing valve is moved from said third position to said first position.

4. An apparatus as recited in claim 2, further comprising:

a hose having first and second ends, said first end of said hose adapted to couple to said second orifice; and wherein retained liquid from said hose flows into said reversing valve through said second orifice when said second end of said hose is elevated above said second orifice and the position of said reversing valve is moved from said third position to said second position.

5. An apparatus as recited in claim 1, wherein a change in position of said reversing valve between said first position and said second position changes the flow rate of liquid flowing between said first orifice and said second orifice.

6. An apparatus as recited in claim 1, wherein a change in position of said reversing valve between said first position and said second position changes the liquid pressure difference between said first orifice and said second orifice.

7. An apparatus as recited in claim 1, further comprising a drain plug positioned in said strainer housing.

8. An apparatus as recited in claim 1, wherein liquid flows in one direction through said strainer basket when the position of said reversing valve is changed between said first position and said second position.

9. An apparatus as recited in claim 1, wherein said pump is a constant speed pump.

10. An apparatus as recited in claim 1, wherein said pump is a positive displacement pump.

11. An apparatus as recited in claim 1, further comprising:

an indexing pin coupled to said reversing valve;

wherein the position of said reversing valve is restricted to between said first position and said second position by said indexing pin.

12. An apparatus as recited in claim 1, further comprising:

wherein said reversing valve is adapted to mount to a vehicle having a liquid reservoir;

wherein said first orifice is adapted to couple to said liquid reservoir; and wherein said second orifice is adapted to fluidly couple to a liquid receiver.

13. An apparatus as recited in claim 12:

wherein said reversing valve has a third position;

wherein when said reversing valve is in said third position, a liquid pressure difference will not develop between said first orifice and said second orifice; and wherein retained liquid in said reversing valve and in said pump is discharged through said purge valve when said pump is operating, said purge valve is opened, and said reversing valve is moved from said third position to said first position.

14. An apparatus as recited in claim 13, further comprising:

a hose having first and second ends, said first end adapted to couple to said second orifice; and wherein retained liquid from said hose flows into said reversing valve through said second orifice when said second end of said hose is elevated above said second orifice and the position of said reversing valve is moved from said third position to said second position.

15. An apparatus for managing the flow of a liquid and adapted to couple to a pump having an inlet and outlet comprising:

a valve body having a first, second, third and fourth ports;

wherein said first port is adapted to couple to the inlet of a pump;

wherein said second port is adapted to couple to a first containment vessel;

wherein said third port is adapted to couple to the outlet of said pump;

wherein said fourth port is adapted to couple to a second containment vessel;

a valve chamber in the center of said valve body;

a valve candle adapted to rotate within said valve chamber;

said valve candle having a flat impeller;

said valve candle having first, second and third positions;

wherein when said valve candle is in said first position, said impeller directs liquid flow from said second port to said first port, and from said third port to said fourth port;

wherein when said valve candle is in said second position, said impeller directs liquid flow from said fourth port to said first port and from said third port to said second port; and wherein when said valve candle is in said third position, said impeller allows liquid to flow from said third port to said first port.

16. An apparatus as recited in claim 15, further comprising:

an indexing pin attached to said valve candle;

a valve bonnet coupled to said valve body;

indexing ears attached to said valve bonnet;

wherein said indexing ears interact with said indexing pin to limit the turning range of said valve candle.

17. An apparatus as recited in claim 15, further comprising:

wherein said valve candle has a top shaft and a bottom shaft;

wherein said top shaft is supported by said valve bonnet;

a coil spring positioned on said top shaft between said valve bonnet and said valve candle;

a jack screw positioned in said valve body;

said jack screw adapted to support said bottom shaft;

wherein said coil spring urges said bottom shaft of said valve candle against said jack screw.

18. An apparatus as recited in claim 17, wherein adjusting said jack screw adjusts the position of said valve candle in said valve chamber.

19. An apparatus as recited in claim 17, further comprising:

a first recessed O ring on said top shaft;

said first O ring positioned to seat in said valve bonnet;

a second recessed O ring on said bottom shaft;

said second recessed O ring positioned to seat in said valve body;

wherein said first and second recessed O rings are adapted to resist liquid flow along said top and bottom shafts.

20. An apparatus as recited in claim 15, further comprising:

first, second, third and fourth recessed O rings positioned on said first, second, third and fourth ports respectively;

wherein said first second third and fourth O rings are adapted to resist liquid flow across the face of said ports.

21. An apparatus as recited in claim 15, further comprising:

a strainer housing adapted to couple to the inlet of said pump;

a strainer basket positioned in said strainer housing;

wherein said strainer housing is fluidly coupled to said first port.

22. An apparatus as recited in claim 21, wherein liquid flows in one direction through said strainer basket when the position of said valve candle is changed between said first position and said second position.

23. An apparatus as recited in claim 15:

wherein said valve body is mounted to a vehicle; and wherein said fourth port is fluidly coupled to a crossover line that will access liquid from both sides of said vehicle.

24. An apparatus as recited in claim 23, wherein said second port is fluidly connected to a second crossover line that will access liquid from both sides of the vehicle.

25. An apparatus as recited in claim 23:

wherein said second port is adapted to couple to a first containment vessel mounted on said vehicle; and wherein said crossover line is adapted to couple to a second containment vessel.

26. An apparatus as recited in claim 23, further comprising:

a hose having first and second ends, said first end adapted to couple to said crossover line; and wherein retained liquid from said hose flows into said valve body through said fourth port when said second end of said hose is elevated above said crossover line and the position of said valve candle is moved from said third position to said second position.

27. A method of distributing liquid comprising:

providing a pump having an inlet and an outlet;

providing a two way flow reversing valve having a first, second, third and fourth ports;

coupling said pump inlet to said first port;

coupling said pump outlet to said third port;

coupling a first containment vessel to said second port;

coupling a second containment vessel to said fourth port;

wherein said flow reversing valve has a first position and second position;

engaging said pump;

moving said flow reversing valve to said first position; and distributing liquid from said first containment vessel to said second containment vessel.

28. A method of distributing liquid as recited in claim 27, further comprising:

wherein said flow reversing valve has a third position;

wherein when said flow reversing valve is in said third position, liquid does not flow between said second port and said fourth port; and positioning said flow reversing valve in said third position before said pump is engaged.

29. A method of distributing liquid as recited in claim 27, further comprising:

providing a hose having a first end and second end;

coupling said first end of said hose to said fourth port; and coupling said second end of said hose to said second containment vessel.

30. A method of distributing liquid as recited in claim 29, further comprising:

uncoupling said second end of said hose from said second containment vessel;

elevating said second end of said hose above said fourth port; and moving said flow reversing valve to said second position to remove said retained liquid from said hose.

31. A method of distributing liquid as recited in claim 27, further comprising:

coupling a purge valve to said pump outlet;

disconnecting said second containment vessel from said fourth port;

engaging said pump;

opening said purge valve;

moving said flow reversing valve to said first position thereby discharging retained liquid through said purge valve.

32. A method of distributing liquid as recited in claim 31, further comprising:

providing a strainer housing coupled to said inlet of said pump and coupled to said flow reversing valve;

flowing liquid in a first direction through said strainer housing when said flow reversing valve is in said first position; and flowing liquid in said first direction through said strainer housing when said flow reversing valve is in said second position.

33. A method of distributing liquid as recited in claim 32, further comprising:

providing a drain port in said strainer housing;

opening said drain port to drain retained liquid from said strainer housing.

34. A method of distributing liquid as recited in claim 27, further comprising:

supporting said first containment vessel on a vehicle;

supporting said pump on said vehicle; and supporting said flow reversing valve on said vehicle.

35. A method of distributing liquid as recited in claim 34, further comprising:

coupling a purge valve to said pump outlet;

disconnecting said second containment vessel from said fourth port;

engaging said pump;

opening said purge valve;

moving said flow reversing valve to said first position thereby discharging retained liquid through said purge valve.

36. A method of distributing liquid as recited in claim 35, further comprising:

supporting a third containment vessel from said vehicle;

disconnecting said first containment vessel from said second port;

connecting said third containment vessel to said second port;

engaging said pump;

moving said flow reversing valve to said first position; and distributing liquid from said third containment vessel through said fourth port.

37. A method of distributing liquid as recited in claim 27, further comprising:

disconnecting said second containment vessel from said fourth port;

connecting a liquid source to said fourth port;

engaging said pump;

moving said flow reversing valve to said second position thereby refilling said first containment vessel from said liquid source.

38. A method of distributing liquid as recited in claim 37, further comprising:

coupling a purge valve to said pump outlet;

disconnecting said liquid source from said fourth port;

engaging said pump;

opening said purge valve;

moving said flow reversing valve to said first position thereby discharging retained liquid through said purge valve.

* * * * *